United States Patent [19]

Hounsel et al.

[11] 4,381,634

[45] May 3, 1983

[54] FIBER BLANKET INSULATION MODULE

[75] Inventors: Mack A. Hounsel; Carlisle O. Byrd, Jr., both of Houston, Tex.

[73] Assignee: Manville Service Corporation, Denver, Colo.

[21] Appl. No.: 245,946

[22] Filed: Mar. 20, 1981

[51] Int. Cl.[3] ..... E04B 1/80

[52] U.S. Cl. ..... 52/506; 52/404; 52/509; 110/336

[58] Field of Search ..... 52/506, 509, 513, 404, 52/511; 110/331, 336, 338

[56] References Cited

U.S. PATENT DOCUMENTS

| | | | |
|---|---|---|---|
| 3,400,672 | 9/1968 | Dickson | 52/506 X |
| 3,819,468 | 6/1974 | Sauder et al. . | |
| 3,832,815 | 9/1974 | Balaz et al. . | |
| 3,854,262 | 12/1974 | Brady | 52/404 |
| 3,892,396 | 7/1975 | Monaghan . | |
| 3,952,470 | 4/1976 | Byrd, Jr. . | |
| 4,001,996 | 1/1977 | Byrd, Jr. . | |
| 4,055,926 | 11/1977 | Byrd, Jr. . | |
| 4,086,737 | 5/1978 | Byrd, Jr. . | |
| 4,103,469 | 8/1978 | Byrd, Jr. . | |
| 4,123,886 | 11/1978 | Byrd, Jr. . | |
| 4,218,962 | 8/1980 | Cunningham et al. | 52/509 |
| 4,287,839 | 9/1981 | Severin et al. | 110/331 |
| 4,339,902 | 7/1982 | Cimochowski et al. | 52/506 |

OTHER PUBLICATIONS

T. E. Smith, CER-Wool "Nip & Tuck" Modular System, 9/20/79, whole article.

T. E. Smith, "Nip and Tuck" Modules, 8/29/80, whole article.

*Primary Examiner*—J. Karl Bell

*Attorney, Agent, or Firm*—R. M. Halvorsen; R. K. Thomson

[57] ABSTRACT

Refractory ceramic fiber blanket modules with a continuous strip of ceramic fiber material folded into a number of layers in a serpentine fashion are used to insulate high temperature equipment. The blanket is supported by support structure which penetrates the blanket in the vicinity of folds near the furnace wall, providing increased strength against tearing away of the blanket from the supports.

12 Claims, 6 Drawing Figures

52
14
32
28
S
16
52
20
12
22
M
14
10
B
12
16
18
50
46
48
44
44
32
36
38
34
40
34
40
S
42
38
42
52
30
28
26
26
24
22
24
52

FIBER BLANKET INSULATION MODULE

FIELD OF INVENTION

The present invention relates to modular refractory ceramic fiber blanket insulation systems.

DESCRIPTION OF PRIOR ART

U.S. Pat. Nos. 3,952,470 and 4,001,996 each relate to modular refractory ceramic fiber blocks formed from folded ceramic fiber blankets for insulating furnaces and the like. In these modules, supporting rods were mounted within and extended along certain of the folds in the blankets. Other U.S. Patents relating to insulation modules of which one of applicants is inventor are U.S. Pat. Nos. 4,055,926; 4,086,737; 4,103,469; and 4,123,886.

Another type of modules, such as in U.S. Pat. Nos. 3,819,468 and 3,832,815 has utilizes wires or pins extending transversely through a number of aligned strips of "edge grain" ceramic fiber material to hold the strips together in the module. However, the purpose of these wires or pins was not apparently for support of the modules when installed, since other support mechanisms were provided for the modules.

Another type of furnace insulation impaled the insulative blanket onto spears or hangers generally parallel to the furnace walls. These spears had to be installed prior to the blanket being attached, causing a more complicated installation. Examples of this type of insulation are U.S. Pat. No. 3,892,396 and the type sold as "Nip & Tuck" modules by C-E Refractories, Combustion Engineering, Inc. of Valley Forge, Pennsylvania.

SUMMARY OF INVENTION

Briefly, the present invention comprises a new and improved ceramic fiber blanket module for insulating an inner surface, such as a wall or roof or the like, in a furnace or other type of heating or heat-treating equipment. The module is formed from plural folds of adjacent layers of refractory ceramic fiber insulating material which are supported on the inner wall of the furnace.

The folded insulating blanket is preferably formed from a continuous strip of ceramic fiber material folded into a number of layers in a serpentine or undulating form. The folded blanket has an inner surface portion to be exposed along an insulation surface to interior conditions in the furnace and an outer surface portion adapted to be mounted against a wall of the furnace. Side portions of adjacent layers extend generally perpendicularly to the furnace wall and parallel to each other and are folded into U-shaped folds at inner and outer ends adjacent the inner and outer surfaces to form alternating inner and outer folds.

The folded insulating blanket is supported on the furnace inner surface by supports which extend through plural side portions of the blanket adjacent the outer folds. Suspension members are mounted on the outer surface of the blanket adjacent layers to receive the supports. The suspension members are attached by attachment structure to the inner surface of the furnace. With the supports extending through the side portions of blanket and mounted adjacent the outer folds, improved strength and resistance to tearing or pull-away of the blanket from the supports has been found to be achieved with the present invention.

DESCRIPTION OF THE PREFERRED EMBODIMENTS

Figures 1, 2:
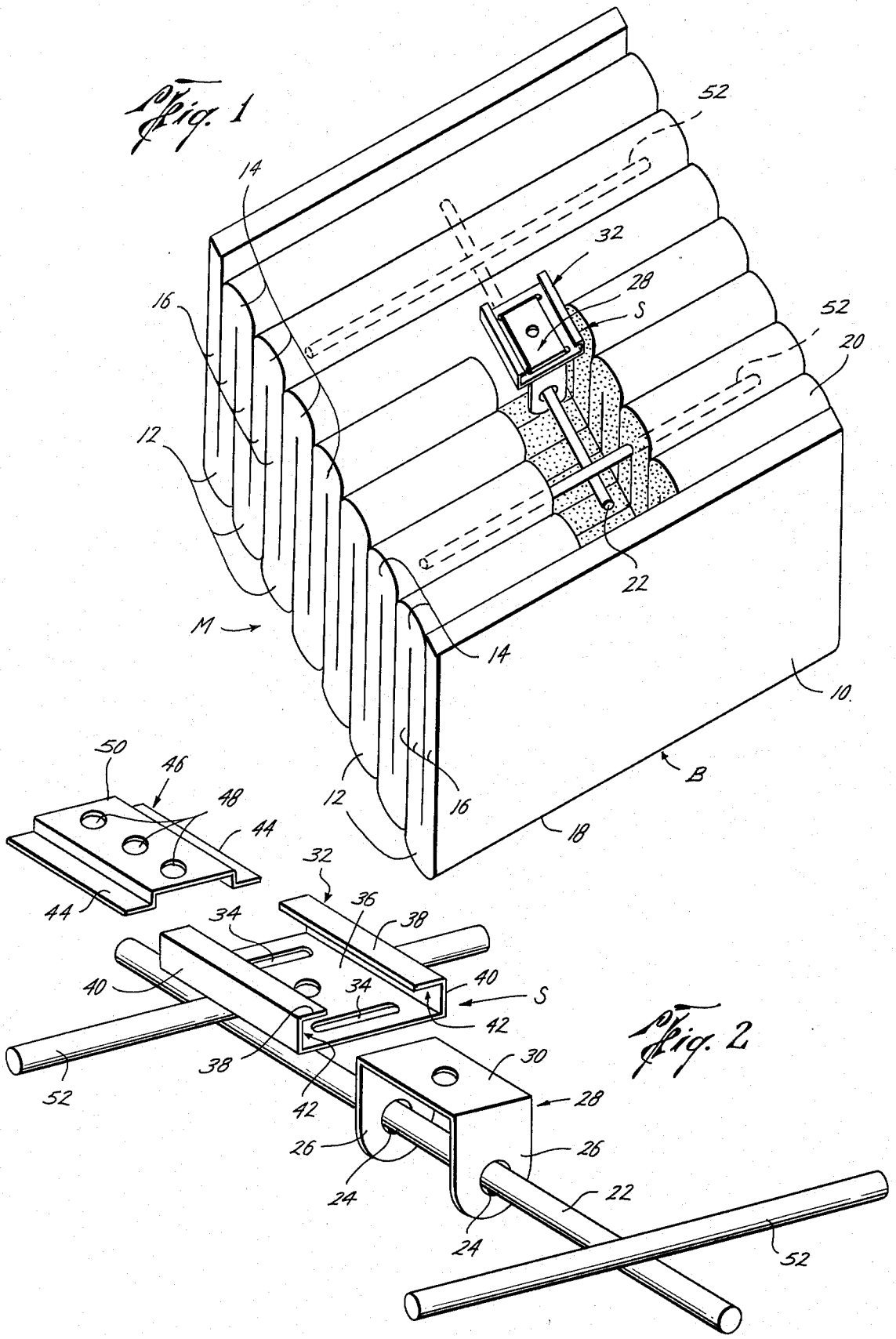
FIG. 1 is an isometric view, taken partly in cross-section, of an insulation module according to the present invention.
FIG. 2 is an exploded isometric view of supporting structure for the module of FIG. 1.

In the drawings, the letter M (FIG. 1) designates generally a refractory ceramic fiber blanket module or block for mounting with an inner surface, such as a wall or roof, of a furnace or other heating, heat treating or high temperature equipment. For this reason, furnace and high temperature equipment will be used interchangeably in this description. The module M is preformed from a folded insulating blanket B and is supported on the inner surface by support structure S (FIGS. 1 and 2).

The blanket B may be any of several commercially available high temperature refractory ceramic fiber blanket materials, such as those containing aluminum-silica fibers as disclosed in U.S. Pat. Nos. 3,952,470 and 4,001,996. The blanket B is preferably in the form of a continuous strip 10 of the ceramic fiber blanket material folded into alternate U-shaped inner folds 12 and outer folds 14 interconnected with each other by parallel side portions 16. The side portion 16 extend between an inner surface 18 adjacent the inner folds 12 and an outer surface 20 adjacent the outer folds 14. The inner surface 18, commonly referred to in the art as a "hot face," is exposed to internal conditions in the high temperature equipment being insulated, while the outer surface 20 is adapted to be mounted against the inner surface of the equipment by the supports S.

In the support S (FIGS. 1 and 2), a support means 22 in the form of a rod or bar extends through a plurality of side portions 16 of the blanket B adjacent the outer folds 14 to support the blanket in place when the module M is installed. The blanket B, on installation, is normally in a state of compression, and thus because of this and the frictional engagement between the fibers of the blanket and the rod 22, the rod 22 need not extend completely through the entire blanket B. It should be understood that rod 22 may, however, extend completely through the blanket B, if desired. Rod 22 is shown in the preferred embodiment as a solid rod of suitable material, such as a stainless steel of suitable temperature characteristics based on temperature conditions in the equipment. It should be understood, however, that other shaped members may serve as a support means. For example, a hollow tubular member, a bar or rod of generally rectangular cross-section or other suitable shape of elongate member may be used as a support means with the present invention.

The support rod 22 extends through openings 24 in suspension tabs 26 of a suspension arm 28 of the support S. The suspension tabs 26 are interconnected by a connector member 30 and are adapted to be inserted adjacent outer folds 14 at spaced positions from each other on the blanket B, with the length of the connector member 30 determining the amount of such spacing.

The suspension arm 28 is connected with a slide channel member 32 by insertion of suspension tabs 26 through elongate slots 34 formed in a center plate portion 36 of slide channel 32. The slide channel 32 further has mounting rails 38 spaced from the plate member 36 by connecting arms 40 to form receiving slots 42. The receiving slots 42 receive depressed side arms or rails 44 of an attachment member 46. The attachment member 46 has one or more openings 48 formed in an upper portion 50 therein so that the member 46 may be stud welded or otherwise attached to the inner surface of the equipment being insulated. Although shown in the drawing as a member of generally rectangular shape, the attachment member 46 could also be formed in other shapes, such as in the form of a washer with a depressed outer rim to fit within receiving slots 42 of the slide channel 32.

If desired, or if required in particular situations, the support S may also include a suitable number, depending upon support requirements, of folds support rods 52, each mounted in a different fold 16 between the support rod 22 and the material of the blanket B adjacent the inner surface of the furnace. However, it should be understood that rods 52 need not be used in some situations, with the single rod 22 securing each fold of the blanket B and providing adequate support.

Figure 3:
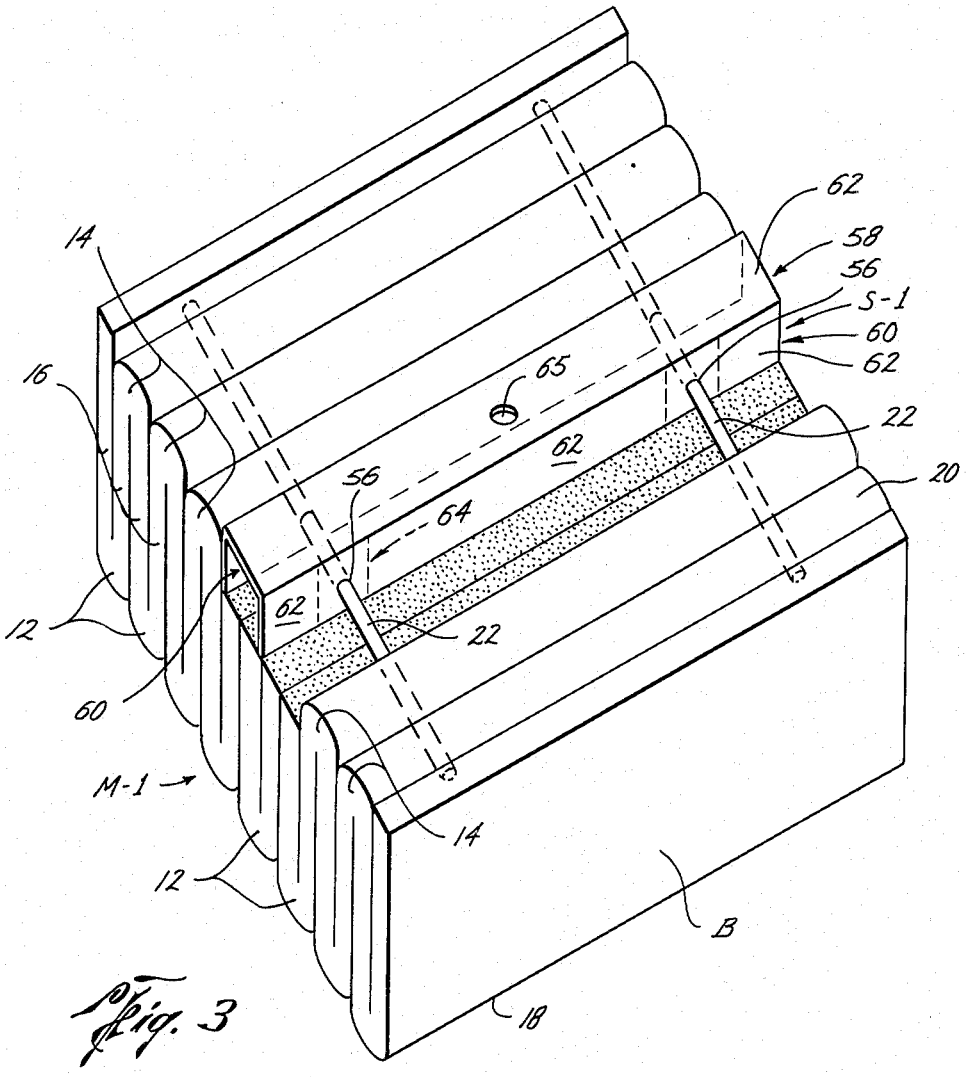
FIG. 3 is an isometric view, taken partly in cross-section of another insulation module according to the present invention.
Figure 4:
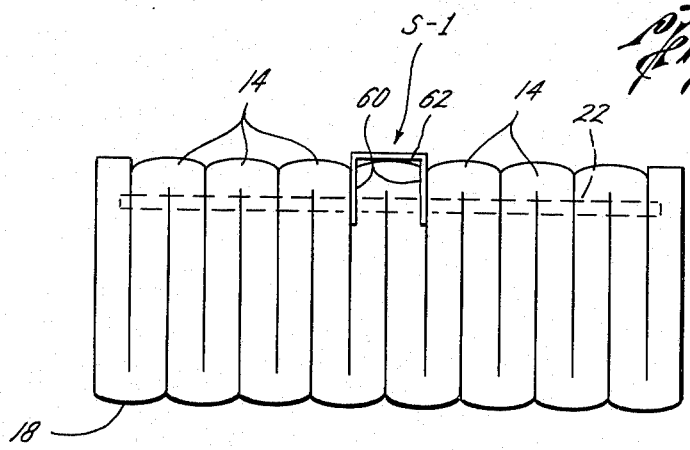
FIG. 4 is a side elevation view of the module of FIG. 3.

In a module M-1 (FIGS. 3 & 4) of the present invention, the blanket B is formed in a like manner to the blanket of the module M. In module M-1, the blanket B is supported by a support S-1.

The support S-1 includes a plurality of suspension rods which are like rod 22 of FIG. 1 and thus bear the same reference numeral. Rod 22 extends through a plurality of the side portion 16 of the blanket B adjacent the outer folds 14 to support the blanket B in place in the furnace when installed. The support rods 22 are mounted at spaced positions from each other, preferably at a common distance from the outer surface portion 20 of the blanket B. Further, the support rods 22 are preferably mounted substantially parallel to each other in a common plane in the blanket B.

Each of the support rods 22 is received in a suitable opening 56 in a suspension arm 58. The suspension arm 58 may be in the form of a pair of unitary suspension tabs 60, having a plurality of openings 56 formed therein for receiving the plural support rods 22, and connected by a connector member 62 which extends across the inner surface 20 of the blanket B substantially equally with the width of the folded blanket B.

Alternatively, portions of the suspension tabs 60 can be removed at area 62 not proximate to the openings 56, as indicated by phantom lines 64, leaving a plurality of individual suspension tab located in pairs at various positions across the width of the connection member 62, with each such suspension tab pair receiving one of the support rods 22. The suspension arm 58 has an opening 65 formed at a suitable location in the connector member 62 through which a bolt or other mounting device may be passed to attach the module M to the furnace wall.

Figure 5:
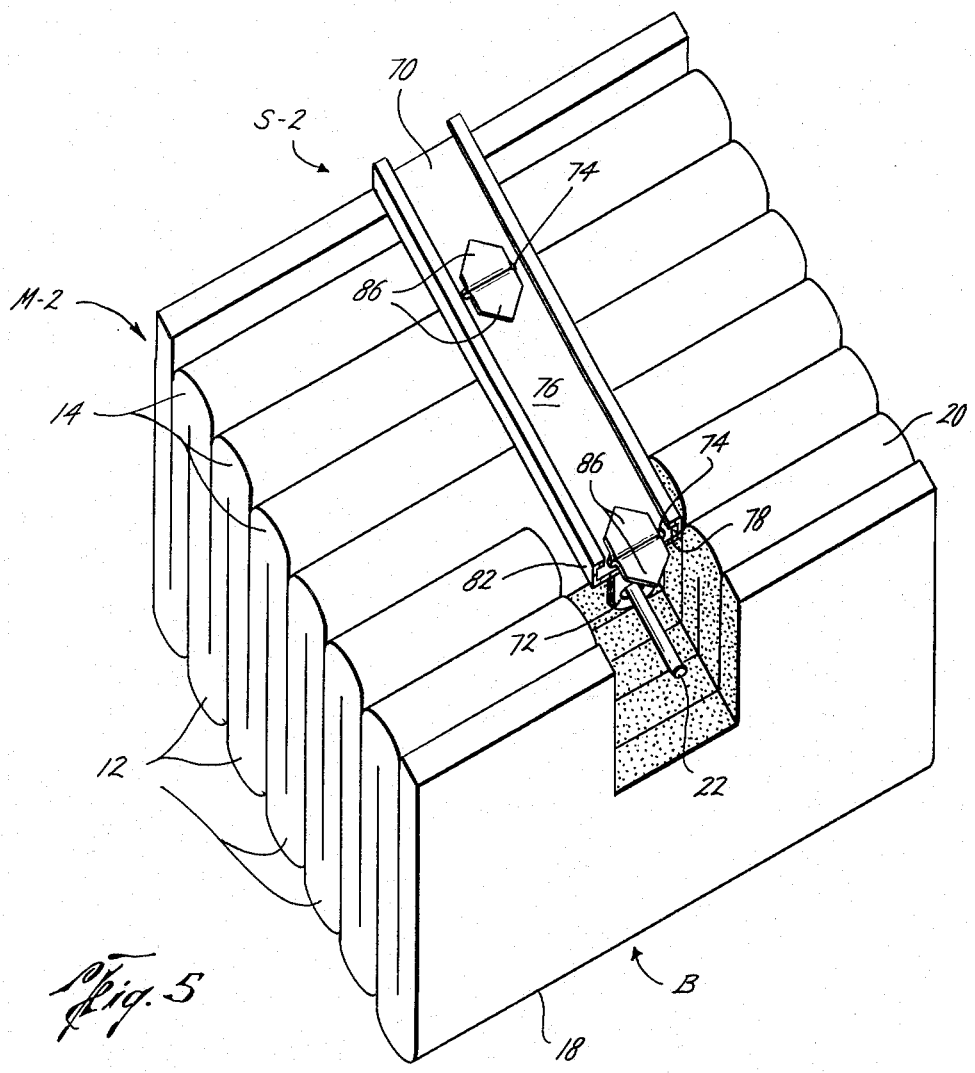
FIG. 5 is an isometric view, taken partly in cross-section, of another insulation module according to the present invention.
Figure 6:
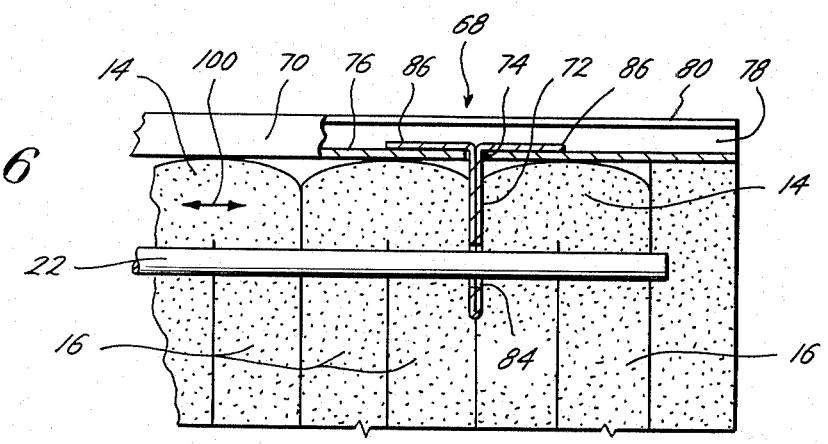
FIG. 6 is a side elevation view, taken partly in cross-section of a portion of the module of FIG. 5.

In a module M-2 (FIGS. 5 & 6) of the present invention, the blanket B is formed in a like manner to the module M and is supported by a support S-2. The support S-2 includes a support rod 22 extending through a plurality of side portions 16 of the blanket B adjacent the outer folds 14 to support the blanket B in place.

The support S-2 is mounted with the blanket B by a suspension arm 68 in the form of an elongate slide channel member 70 having two or more suspension tabs 72 mounted at spaced positions to extend into the blanket B between adjacent outer folds 14 at locations established by slots or openings 72 in a central portion 76 of the slide channel 70.

The slide channel 70 further has a receiving slot 78 formed by mounting rails 80 and connector members 82 for receipt of an attachment member, such as of the type shown in FIG. 2 of the drawings and discussed hereinabove.

The suspension tabs 72 have openings 84 formed for passage of the support rod 22, which extends through the blanket B in a like manner to the modules M and M-1. The suspension tab 72 is preferably formed by bending a strip of suitable metal material, such as stainless steel, to form an inwardly extending portion where the openings 84 may be formed. Further, the support tab 72 has two outer mounting lugs 86 which are bent flat against the central portion 76 of the slide channel 70 once the suspension tabs 72 are properly positioned. The lugs 86 may be spot welded to the slide channel 70, if desired.

It should be understood that the particular structure shown in each of the embodiments of the present invention may be used with the modules of other embodiments. For example, a plurality of support rods 22, each attached with a support S (FIG. 1) may be mounted within the blanket B so that the module M would have a plurality of support rods 22 mounted by support S at spaced positions from each other in the manner of module M-1. Likewise, support rods 22, each with a support S-2 (FIG. 5) may be mounted with the blanket B so that the module M-2 has a plurality of support rods 22 mounted by support S-2 at spaced positions from each other as in the manner of module M-1.

Further, fold support rods 52 of the module M could also be mounted in folds of the blanket B in either of the modules M-1 and M-2 and supported by support rods 22 therein.

The modules of the present invention are formed by folding the blanket B into the configuration shown in the drawings. Suspension arms are then mounted with the outer surface portion 20 so that the suspension tabs extend between adjacent outer folds 14 at the requisite locations within the blanket B. A guide plate or other suitable positioning structure is then brought into proximity with the outermost side portion 16 of the blanket B and the support rods 22 are forced through the side portions 16 of the blanket B and through the openings formed in the suspension tabs of the particular suspension arm being used. If desired, a needle or other piercing device may be mounted ahead of the support rod 22 to facilitate passage of such rod 22 through the blanket B. Once the support rods 22 are properly positioned within the blanket B, the modules of the present invention may be wrapped with a suitable wrapping material to maintain them under compression prior to installation. The modules of the present invention could then be mounted to inner surfaces of the equipment being insulated in any of the several ways set forth in U.S. Pat. Nos. 3,952,470 and 4,001,996.

With the modules of the present invention having the support rods 22 penetrating the side portions 16 of the blanket B in the vicinity of the outer folds 14, preferably substantially at the base of the folds 14, applicants have found that the blankets B being penetrated will hold significantly longer and at significantly greater weight loads against tearing than blankets of the edge grain type. Tearing is a phenomenon which occurs in modular ceramic refractory fiber blankets, since the fibers of such blankets are generally deposited in planes along the length of blanket B. Thus, with edge-grain fiber blanket modules, the strips of such modules are mounted in the modules so that when the rod passes through these strips transversely through the plane in which the fibers in the blanket have their greatest strength against tearing. Conversely, with the present invention, the upper fold 14 provides a mass of fiber blanket material having the fibers running in a plane, indicated generally by an arrow 100 (FIG. 6), where the fibers exhibit their greatest strength against tearing. Thus, applicants have found that the modules of the present invention exhibit increased strength against tearing forces which might tend to cause the blanket B to fall from the wall of the furnace in use.

Further, only the folds of the blanket B between the suspension members restrict the folds of the blanket moving along the support rod 22. The compression in the unrestricted folds of the blanket B is available for use in forming a tight joint with modules, since the unrestricted folds may move along the rods 22.

The foregoing disclosure and description of the invention are illustrative and explanatory thereof and various changes in the size, shape and materials as well as in the details of the preferred embodiment may be made without departing from the spirit of the invention.

We claim:

1. A refractory ceramic fiber blanket module for insulating an inner surface, such as a wall, of a furnace or the like, comprising:

(a) an insulating blanket folded into a plurality of folds of adjacent layers of refractory ceramic fiber insulating material, said blanket comprising:
  (1) an inner surface portion exposed along an insulation surface to the interior of the furnace;
  (2) an outer surface portion adapted to be mounted against a wall of the furnace; and
  (3) side portions formed from said layers and being folded adjacent said inner and outer surface portions to form alternating inner and outer folds; and (b) means for supporting said blanket on the inner surface of the furnace, comprising:
  (1) support means extending through a plurality of said side portions of said blanket adjacent said outer folds to support said blanket in place;
  (2) suspension means mounted on said outer surface portion of said blanket extending between a plurality of adjacent layers forming an inner fold therebetween for receiving said support means; and
  (3) means for attaching said suspension means to the inner surface of the furnace.

2. The module of claim 1, wherein said means for supporting further includes:

fold support means mounted in at least one of said folds between said support rod means and the furnace inner surface.

3. The module of claim 2, wherein said fold support means comprises:

a plurality of fold support rods, each mounted in a different one of said folds in contact with said support rod means.

4. The module of claim 1, wherein said support means comprises:

a plurality of support rods mounted at spaced positions from each other at a common distance from said outer surface portion of said blanket.

5. The module of claim 4, wherein:

said plurality of support rods are mounted substantially parallel to each other in a common plane in said blanket.

6. The module of claim 5, wherein said plurality of support rods are mounted substantially parallel to each other in a common plane in said blanket;

a plurality of suspending tabs adapted for insertion at spaced folds of said blanket, said tabs having openings formed therein for receiving said support rod means; and said plurality of suspending tabs in each of said spaced folds further comprising a suspending tab for each of said plurality of support rods.

7. The module of claim 1, wherein said suspension means comprises:

a plurality of suspending tabs adapted for insertion at spaced folds of said blanket, said tabs having openings formed therein for receiving said support rod means.

8. The module of claim 7, further including:

connector means for interconnecting said plurality of suspending tabs.

9. The module of claim 8, wherein said connector means extends across said inner surface of said blanket substantially equally with one dimension of said folded blanket.

10. The module of claim 7, wherein said plurality of suspending tabs have mounting lugs formed at end portions thereof for engagement with said means for attaching.

11. The module of claim 10, wherein said means for attaching comprises:

a slide channel member having openings formed therein for receiving said mounting lugs of said suspension tabs.

12. The module of claim 1, wherein said means for attaching comprises:

(a) a slide channel member for receiving said suspension means; and (b) a mounting member adapted for sliding engagement with said slide channel member, said mounting member having an opening for receiving a stud or bolt for attachment to the inner surface of the furnace.

* * * * *